US010527058B2

(12) United States Patent
Kim et al.

(10) Patent No.: US 10,527,058 B2
(45) Date of Patent: Jan. 7, 2020

(54) PROPELLER FAN AND AIR CONDITIONER HAVING THE SAME

(71) Applicant: Samsung Electronics Co., Ltd., Gyeonggi-do (KR)

(72) Inventors: Yeon Je Kim, Suwon-si (KR); Seong Hyun Yoon, Seoul (KR); Jin Baek Kim, Hwaseong-si (KR); Eung Ryeol Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 90 days.

(21) Appl. No.: 15/711,997

(22) Filed: Sep. 21, 2017

(65) Prior Publication Data

US 2018/0080468 A1 Mar. 22, 2018

(30) Foreign Application Priority Data

Sep. 21, 2016 (KR) ..... 10-2016-0120453

(51) Int. Cl.

| | |
|---|---|
| ***F04D 29/38*** | (2006.01) |
| ***F04D 29/32*** | (2006.01) |
| ***F04D 29/66*** | (2006.01) |
| *F24F 1/38* | (2011.01) |

(52) U.S. Cl.

CPC ..... *F04D 29/388* (2013.01); *F04D 29/325* (2013.01); *F04D 29/329* (2013.01); *F04D 29/384* (2013.01); *F04D 29/66* (2013.01); *F24F 1/38* (2013.01)

(58) Field of Classification Search

CPC .... F04D 29/388; F04D 29/325; F04D 29/329; F04D 29/384; F04D 29/66; F24F 1/38

USPC ..... 416/201 R

See application file for complete search history.

(56) References Cited

U.S. PATENT DOCUMENTS

| | | | | |
|---|---|---|---|---|
| 1,467,725 | A * | 9/1923 | Higgs | B63H 1/15 416/236 R |
| 8,157,532 | B2 * | 4/2012 | Matesanz Gil | F03D 1/0608 415/914 |
| 2007/0284848 | A1 * | 12/2007 | Brownlie | B62K 19/06 280/288.1 |
| 2010/0092297 | A1 * | 4/2010 | Surls | F04D 29/325 416/204 R |
| 2011/0200445 | A1 | 8/2011 | Takeda et al. | |
| 2014/0338388 | A1 | 11/2014 | Kim et al. | |
| 2014/0341748 | A1 * | 11/2014 | Kojima | F04D 29/023 416/234 |

(Continued)

FOREIGN PATENT DOCUMENTS

| | | | |
|---|---|---|---|
| EP | 2784328 | A1 | 10/2014 |
| JP | 2000345995 | A | 12/2000 |

(Continued)

OTHER PUBLICATIONS

Extended European Search Report regarding Application No. 17191937.6, dated Jan. 30, 2018, 8 pages.

*Primary Examiner* — Joseph J Dallo
*Assistant Examiner* — Yi-Kai Wang

(57) ABSTRACT

A propeller fan that includes a hub body with a shaft coupling portion. The propeller fan also includes a plurality of hub blades extending spirally from the hub body. The propeller fan additionally includes a plurality of blades extending outward from the hub body and the hub blade to generate an airflow in an axial direction.

20 Claims, 11 Drawing Sheets

(56) References Cited

U.S. PATENT DOCUMENTS

| | | | | |
|---|---|---|---|---|
| 2018/0003190 | A1* | 1/2018 | Hamada | F04D 29/34 |
| 2018/0355884 | A1* | 12/2018 | Sakoda | F04D 29/384 |

FOREIGN PATENT DOCUMENTS

| | | | |
|---|---|---|---|
| JP | 201182689 | A | 7/2001 |
| JP | 2014206054 | A | 10/2014 |
| JP | 2016070089 | A | 5/2016 |
| KR | 20050118883 | A | 12/2005 |
| KR | 20090132786 | A | 12/2009 |
| KR | 20100068539 | A | 6/2010 |
| KR | 20110067168 | A | 6/2011 |
| KR | 20140057221 | A | 5/2014 |
| KR | 20140136180 | A | 11/2014 |
| KR | 1497342 | B1 | 3/2015 |
| KR | 20150065374 | A | 6/2015 |
| WO | 0015961 | A1 | 3/2000 |
| WO | 2010047001 | A1 | 4/2010 |
| WO | 2016021555 | A1 | 2/2016 |

* cited by examiner

PROPELLER FAN AND AIR CONDITIONER HAVING THE SAME

CROSS-REFERENCE TO RELATED APPLICATION(S) AND CLAIM OF PRIORITY

This application is related to and claims priority to Korean Patent Application No. 10-2016-0120453 filed on Sep. 21, 2016, the contents of which are incorporated herein by reference.

TECHNICAL FIELD

Embodiments of the present disclosure relate to a propeller fan as a type of axial-flow fan forming an air flow in an axial direction and an air conditioner including the propeller fan.

BACKGROUND

In general, propeller fans are axial-flow fans that include a cylindrical hub to which a rotary shaft of a driving motor is coupled and a plurality of blades extending outward from the hub to form an air flow in an axial direction. Such propeller fans have been used in outdoor units of air conditioners to force air to flow.

In this regard, the hub disposed at the center of the propeller fan receives a rotational force from the rotary shaft of the driving motor and firmly supports the plurality of blades thereby providing sufficient rigidity to the plurality of blades while the propeller fan rotates at a high speed.

However, although the hub does not make any contribution to the blowing efficiency, a relatively large size is required to support the propeller fan blades and thus the overall weight of the propeller fan increases resulting in an increase in manufacturing costs thereof.

In addition, if an angle of the blade increases to be greater than a predetermined level to increase an airflow volume of the propeller fan, flow resistance and noise may increase due to flow separation on the surface of the blade.

SUMMARY

To address the above-discussed deficiencies, it is a primary object to provide a propeller fan having a lightweight and manufactured with low costs by increasing rigidity of blades and reducing the size of a hub and an air conditioner including the propeller fan.

It is another aspect of the present disclosure to provide a propeller fan including a small and lightweight hub with high rigidity by improving the structure of the hub and an air conditioner including the propeller fan.

It is another aspect of the present disclosure to provide a propeller fan in which stress is distributed to prevent concentration of the stress between blades and a hub and an air conditioner including the propeller fan.

It is another aspect of the present disclosure to provide a stackable propeller fan easily stored and transported and an air conditioner including the propeller fan.

It is another aspect of the present disclosure to provide a propeller fan providing a high air volume by increasing an angle of blades and low noise and an air conditioner including the propeller fan.

It is another aspect of the present disclosure to provide a propeller fan having improved air-flowing performance with a reduced volume and an air conditioner including the propeller fan.

Additional aspects of the disclosure will be set forth in part in the description which follows and, in part, will be obvious from the description, or may be learned by practice of the disclosure.

In accordance with an aspect of present disclosure, a propeller fan includes a hub body having a shaft coupling portion, a plurality of hub blades extending spirally from the hub body, and a plurality of blades extending outward from the hub body and the hub blade to generate an airflow in an axial direction.

The blade may comprise a leading edge disposed at a front portion in a rotational direction, a trailing edge disposed at a rear portion in the rotational direction, and a tip edge connecting the leading edge with the trailing edge, and at least one portion of the hub blade may protrude in a forward direction of the leading edge.

The hub blade may comprise a front side wall disposed at a front portion in the rotational direction, a rear side wall disposed at a rear portion of the rotational direction, and a connection portion configured to connect the front side wall with the rear side wall, and the connection portion may protrude in the forward direction of the leading edge to prevent stress from being concentrated on one portion of the blade.

The plurality of blades may comprise a first blade and a second blade, the plurality of hub blades may comprise a first hub blade and a second hub blade, and a leading edge of the first blade may be connected to a rear side wall of the first hub blade and a trailing edge of the first blade may be connected to a front side wall of the second hub blade.

An axial thickness of the hub blade may be greater than an axial thickness of the blade.

The blade may comprise a plurality of recesses formed on a negative pressure surface of the blade to reduce a thickness of the blade, and the plurality of recesses may be disposed behind the hub blade in the rotational direction.

The hub body may comprise a positioning projection and a positioning groove to allow the propeller fans to be stacked in the axial direction, and the positioning projection may be formed on an upper surface or a lower surface of the hub body, the positioning groove may be formed on a lower surface or an upper surface of the hub body, and the positioning projection and the positioning groove may have shapes corresponding to each other to be axially coupled.

The hub body may comprise a side wall portion from which the blade extends and at least one support rib connecting the shaft coupling portion with the side wall portion, and the side wall portion, the support rib, the front side wall, and the rear side wall may have the same thickness in the axial direction.

The blade may comprise a plurality of vortex generators formed on a positive pressure surface of the blade to reduce flow resistance of the blade.

The blade may comprise a leading edge disposed at a front portion in a rotational direction, a trailing edge disposed at a rear portion in the rotational direction, and a tip edge connecting the leading edge with the trailing edge, and the plurality of vortex generators may be arranged at distances gradually increasing from the hub blade to the tip edge.

In accordance with an aspect of present disclosure, a propeller fan comprises a hub body having a shaft coupling portion, a blade extending outward from the hub body and generating an airflow in an axial direction, and a plurality of vortex generators formed on a positive pressure surface of the blade and arranged at distances gradually increasing from the hub body to an end portion of the blade.

The vortex generator may comprise a front portion, a central portion, and a rear portion along a rotational direction of the blade and may have a thickness increasing from the front portion to the central portion and decreasing from the central portion to the rear portion, the central portion having a maximum thickness.

The central portion and the rear portion may have V-shapes when viewed in an axial direction.

The vortex generator may further comprise a tail portion protruding backward from the central portion to a rear end of the rear portion.

In accordance with an aspect of present disclosure, an air conditioner comprises a main body, a heat exchanger disposed inside of the main body, a propeller fan configured to force air inside the main body to flow, and a driving motor configured to drive the propeller fan, wherein the propeller fan comprises a hub body having a shaft coupling portion to which a rotary shaft of the driving motor is coupled, a blade extending outward from the hub and generating an airflow in an axial direction, a plurality of vortex generators formed on a positive pressure surface of the blade and reducing flow resistance of the blade, and a hub blade extending spirally from the hub body reinforcing strength of the blade.

The blade may comprise a leading edge disposed at a front portion in a rotational direction, a trailing edge disposed at a rear portion in the rotational direction, and a tip edge connecting the leading edge with the trailing edge, and at least one portion of the hub blade may protrude in a forward direction of the leading edge.

The hub blade may comprise a front side wall disposed at a front portion in the rotational direction, a rear side wall disposed at a rear portion in the rotational direction, and a connection portion configured to connect the front side wall with the rear side wall, and the connection portion may protrude in a forward direction of the leading edge to prevent stress from being concentrated on one portion of the blade.

The plurality of blades may comprise a first blade and a second blade, the plurality of hub blades may comprise a first hub blade and a second hub blade, and a leading edge of the first blade may be connected to a rear side wall of the first hub blade and a trailing edge of the first blade may be connected to a front side wall of the second hub blade.

The plurality of vortex generators may be arranged at distances gradually increasing from the hub blade to the tip edge.

The vortex generator may comprise a front portion, a central portion, and a rear portion along a rotational direction of the blade, and the vortex generator may further comprise a tail portion protruding from the central portion to a rear end of the rear portion.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Figure 1:
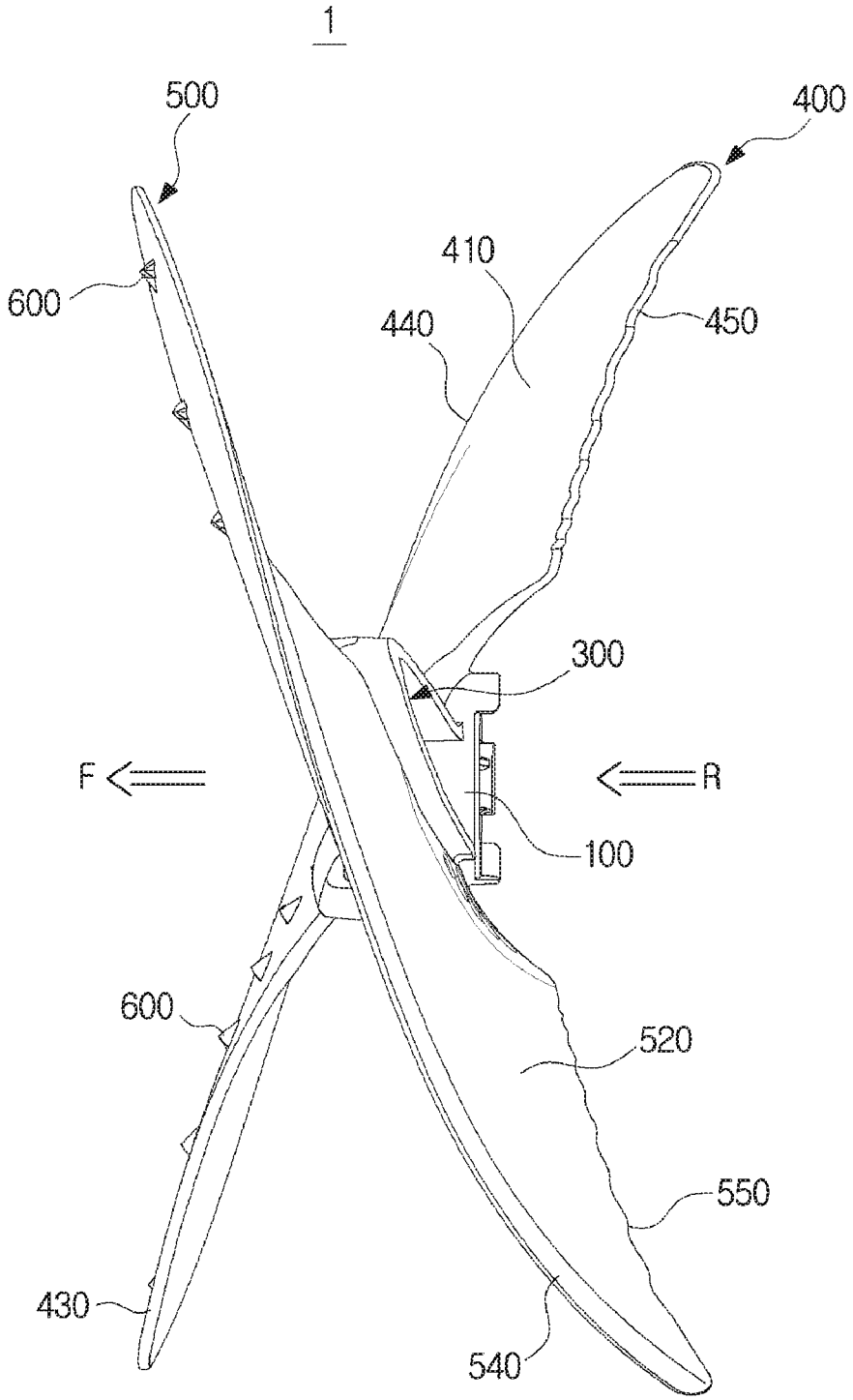
FIG. 1 illustrates a side view of a propeller fan, according to an embodiment of the present disclosure.
Figure 2:
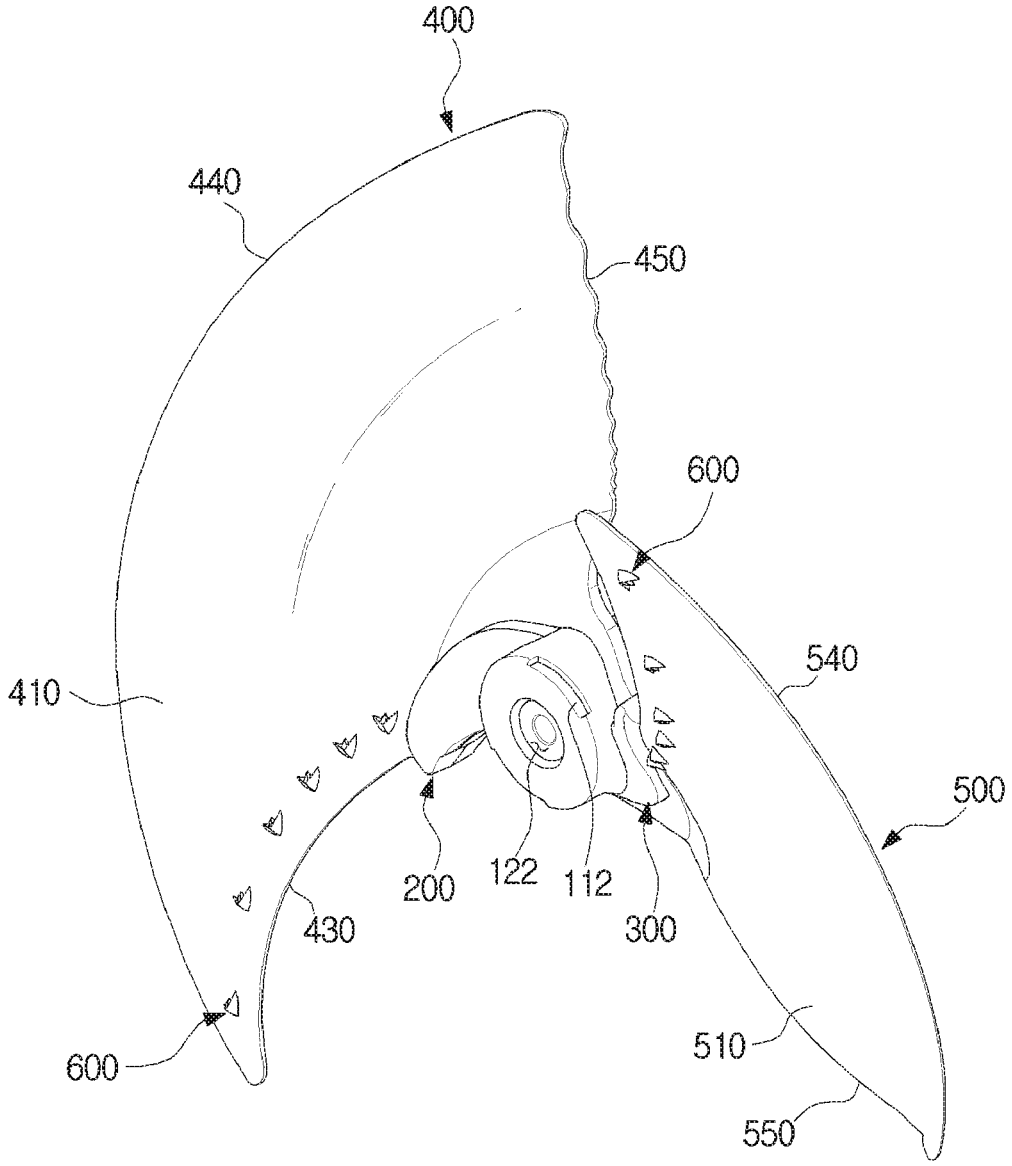
FIG. 2 illustrates a front perspective view of the propeller fan of FIG. 1, according to an embodiment of the present disclosure.
Figure 3:
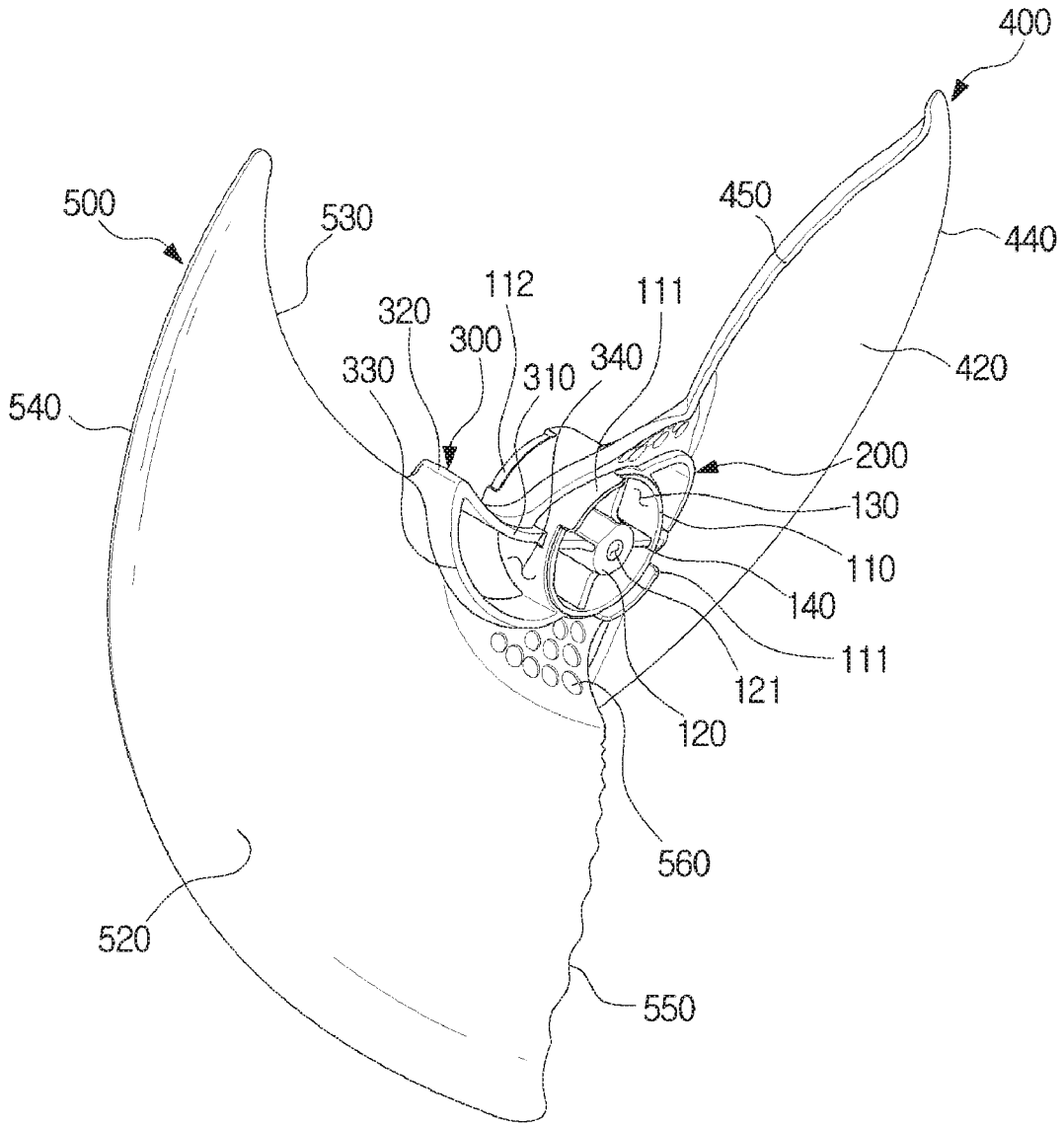
FIG. 3 illustrates a rear perspective view of the propeller fan of FIG. 1, according to an embodiment of the present disclosure.
Figure 4:
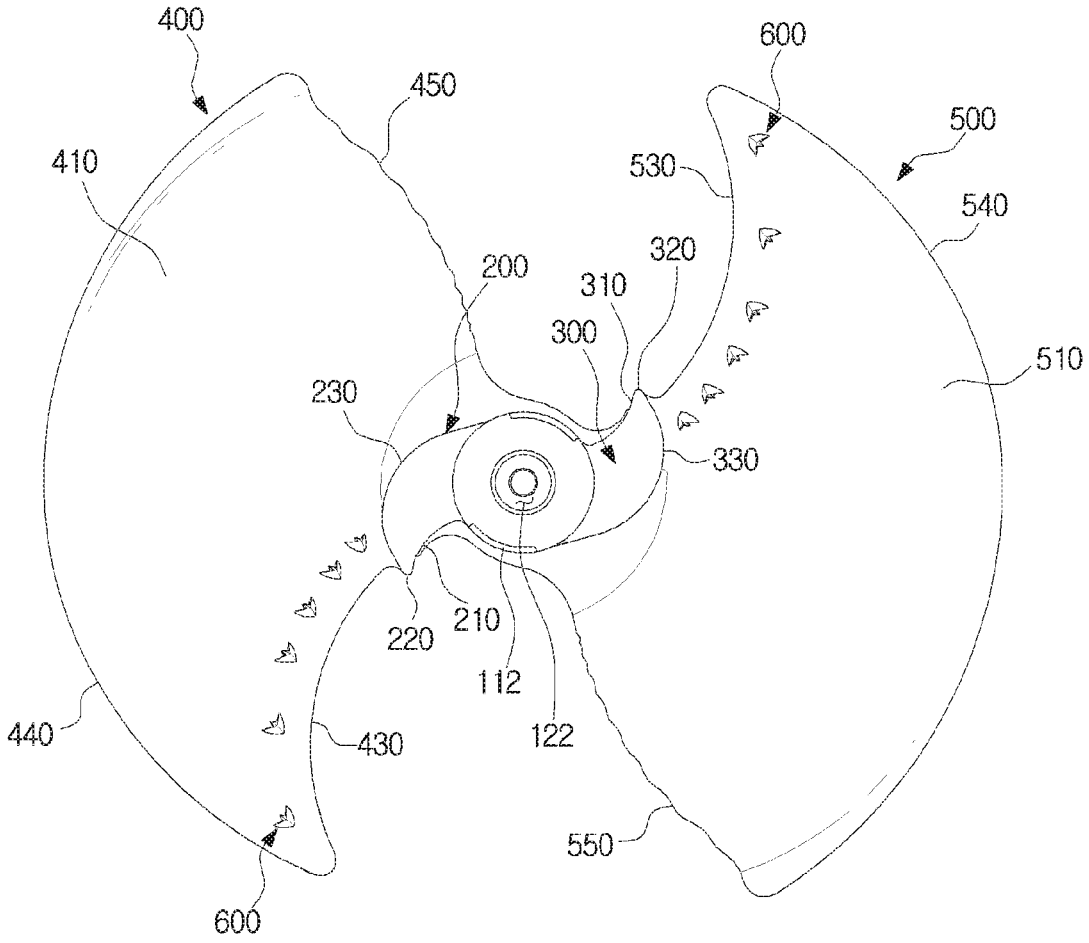
FIG. 4 illustrates a front view of the propeller fan of FIG. 1, according to an embodiment of the present disclosure.
Figure 5:
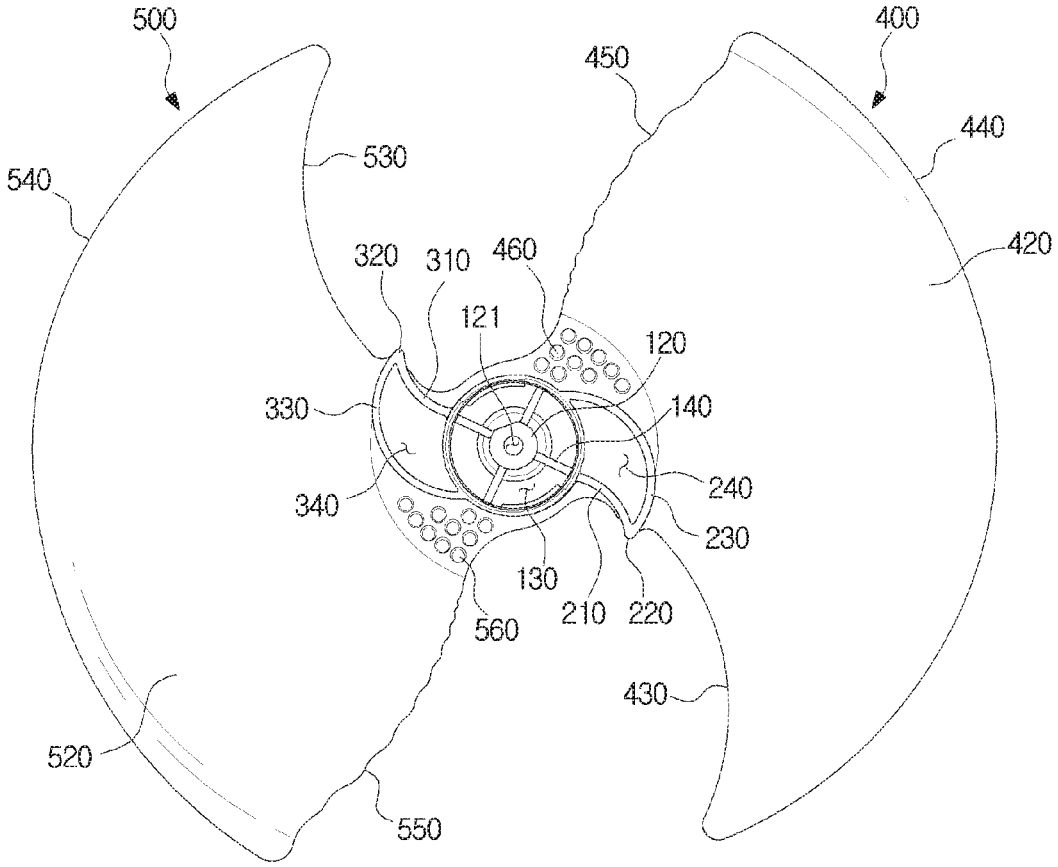
FIG. 5 illustrates a rear view of the propeller fan of FIG. 1, according to an embodiment of the present disclosure.

FIG. 1 is a side view of a propeller fan according to an embodiment of the present disclosure. FIGS. 2 and 3 are front and rear perspective views of the propeller fan of FIG. 1. FIGS. 4 and 5 are front and rear views of the propeller fan of FIG. 1.

Referring to FIGS. 1 to 5, a propeller fan 1 according to an embodiment may include a hub body 100 disposed at a central portion and coupled to a rotary shaft 741 of a driving motor 740 (FIG. 11), a plurality of hub blades 200 and 300 spirally extending from the hub body 100, and a plurality of blades 400 and 500 extending outward from the hub body 100 and the hub blades 200 and 300.

The hub body 100 may be firmly coupled to the rotary shaft 741 via a screw fastening structure or the like and receive a rotational force from the rotary shaft 741. The hub body 100 may have a shaft coupling portion 120 having a shaft coupling hole 121 into which the rotary shaft 741 is inserted and a side wall portion 110 having a circular shape when viewed in an axial direction.

In this regard, a cavity 130 may be formed between the shaft coupling portion 120 and the side wall portion 110 and the shaft coupling portion 120 and the side wall portion 110 may be connected with each other via the plurality of support ribs 140. As the cavity 130 is formed between the shaft coupling portion 120 and the side wall portion 110, the overall weight of the hub body 100 may be reduced.

The plurality of hub blades 200 and 300 may include a first hub blade 200 and a second hub blade 300. The first hub blade 200 and the second hub blade 300 may extend spirally from the side wall portion 110 of the hub body 100 respectively.

The first hub blade 200 and the second hub blade 300 may be provided in the same shape and disposed symmetrically with respect to hub body 100. As illustrated in FIG. 1, the first hub blade 200 and the second hub blade 300 may be provided to be inclined with respect to the side wall portion 110 of the hub body 100 in a forward direction F.

The first hub blade 200 may include a front side wall 210 disposed at a front portion of the propeller fan 1 in the rotational direction, a rear side wall 230 disposed at a rear portion thereof in the rotational direction, and a connection portion 220 configured to connect the front side wall 210 with the rear side wall 230.

The connection portion 220 may protrude in an outwardly forward direction from the first blade 400. A cavity 240 may be formed between the front side wall 210, the rear side wall 230, and the side wall portion 110 of the hub body 100. That is, an inner space surrounded by the front side wall 210, the rear side wall 230, and the side wall portion 110 may be recessed to form the cavity 240.

Similarly, the second hub blade 300 may also include a front side wall 310 disposed at a front portion of the propeller fan 1 in the rotational direction, a rear side wall 330 disposed at a rear portion thereof in the rotational direction, and a connection portion 320 configured to connect the front side wall 310 with the rear side wall 330.

The connection portion 320 may also protrude in an outwardly forward direction of the second blade 500. A cavity 340 may be formed between the front side wall 310, the rear side wall 330, and the side wall portion 110 of the hub body 100. That is, an inner space surrounded by the front side wall 310, the rear side wall 330, and the side wall portion 110 may be recessed to form the cavity 340.

As described above, the overall weight of the propeller fan 1 according to an embodiment may be reduced by forming the cavities 240 and 340 in the hub blades 200 and 300 in addition to the hub body 100.

The plurality of blades 400 and 500 include a first blade 400 and a second blade 500 and the first blade 400 and the second blade 500 may extend outward from the hub body 100 and the hub blades 200 and 300 respectively.

The first blade 400 and the second blade 500 may be provided in the same and disposed symmetrically with respect to the hub body 100. As illustrated in FIG. 1, the first blade 400 and the second blade 500 may be provided to be inclined with respect to the hub body 100 to blow air behind (R) the propeller fan 1 forward (F) along the axial direction. However, the number of blades may also be three or more unlike the present embodiment.

As illustrated in FIGS. 1 to 3, axial thicknesses of hub blades 200 and 300 may be greater than those of the blades 400 and 500. While the propeller fan 1 rotates, stress is concentrated on portions of the blades 400 and 500 adjacent to the hub body 100. Thus, strength of the blades 400 and 500 may be reinforced by forming the hub blades 200 and 300 at the portions where the stress is concentrated. That is, the hub blades 200 and 300 may be formed to reinforce the strength of regions of the blades 400 and 500 on which the stress is concentrated. The hub blades 200 and 300 may have axial thicknesses greater than those of the blades 400 and 500 to reinforce the strength of the blades 400 and 500.

In addition, the hub blades 200 and 300 may be disposed between at least one portion of the blades 400 and 500 and the hub body 100 and connect the at least one portion of the blades 400 and 500 with the hub body 100.

As illustrated in FIG. 4, the first blade 400 may include a leading edge 430 formed at a front portion of the propeller fan 1 in the rotational direction and pulling air, a trailing edge 450 formed at a rear portion thereof in the rotational direction and discharging air, and a tip edge 440 connecting the leading edge 430 with the trailing edge 450 and having an approximately circular arc shape. Thus, the edge of the first blade 400 may be formed continuously by the leading edge 430, the tip edge 440, and the trailing edge 450.

The first blade 400 may have a positive pressure surface 410 as a front surface and a negative pressure surface 420 opposite to the positive pressure surface 410 and the positive pressure surface 410 and the negative pressure surface 420 may be surrounded by the leading edge 430, the tip edge 440, and the trailing edge 450.

Similarly, the second blade 500 may include a leading edge 530 formed at a front portion of the propeller fan 1 in the rotational direction and pulling air, a trailing edge 550 formed at a rear portion thereof in the rotational direction and discharging air, and a tip edge 540 connecting the leading edge 530 with the trailing edge 550 and having an approximately circular arc shape. Thus, the edge of the second blade 500 may be formed continuously by the leading edge 530, the tip edge 540, and the trailing edge 550.

The second blade 500 may have a positive pressure surface 510 as a front surface and a negative pressure surface 520 opposite to the positive pressure surface 510 and the positive pressure surface 510 and the negative pressure surface 520 may be surrounded by the leading edge 530, the tip edge 540, and the trailing edge 550.

The connection portion 220 of the first hub blade 200 may protrude in an outwardly forward direction of the first blade 400. Specifically, the connection portion 220 may protrude in a forward direction of the leading edge 430 of the first blade 400.

The connection portion 220 may prevent the stress from being concentrated on one portion of the leading edge 430 of the first blade 400. In general, stress applied to a blade is concentrated on the leading edge in the propeller fan 1. Particularly, the stress may be concentrated on a portion of the leading edge adjacent to the hub body. By disposing the connection portion 220 at the portion of the first blade 400 on which the stress is concentrated, the stress applied to the first blade 400 may be distributed while preventing concentration of the stress on the portion of the first blade 400. Accordingly, the connection portion 220 may reinforce the strength of the first blade 400. That is, even when a strong stress is applied to the first blade 400, the connection portion 220 may prevent the stress from being concentrated on the first blade 400 so that fatigue limit of the propeller fan 1 may be secured within a reliable range.

Similarly, the connection portion 320 of the second hub blade 300 may protrude in an outwardly forward direction of the second blade 500. Descriptions of the connection portion 320 of the second hub blade 300 which are the same as those given above with regard to the first hub blade 200 will not be repeated.

As illustrated in FIGS. 4 and 5, the leading edge 430 of the first blade 400 may be connected to the rear side wall 230 of the first hub blade 200 and the trailing edge 450 of the first blade 400 may be connected to front side wall 310 of the second hub blade 300. In other words, the trailing edge 550 of the second blade 500 may be connected to the front side wall 210 of the first hub blade 200 and the leading edge 430 of the first blade 400 may be connected to the rear side wall 230 of the first hub blade 200. In this regard, the connection portion 220 of the first hub blade 200 may be disposed between the leading edge 430 of the first blade 400 and the trailing edge 550 of the second blade 500. That is, the plurality of hub blades 200 and 300 and the plurality of blades 400 and 500 may have a continuous shape about the hub body 100. This structure may secure reliability of structural rigidity even when the hub body 100 decreases in size in comparison with conventional hub bodies.

The plurality of blades 400 and 500 may have recesses 460 and 560 to decrease the thicknesses of the blades 400 and 500. The recesses 460 and 560 may be provided on the negative pressure surfaces 420 and 520 of the blades 400 and 500 and recessed in inward directions of the blades 400 and 500 to reduce the thicknesses of the blades 400 and 500.

The plurality of recesses 460 and 560 may be arranged to be adjacent to the hub body 100. In addition, the plurality of the recesses 460 and 560 may be disposed behind the hub blades 200 and 300. Meanwhile, as the recesses 460 and 560 are provided, unnecessary portions of the blades 400 and 500 may be removed. Thus, the weights of the blades 400 and 500 and the overall weight of the propeller fan 1 including the same may be reduced. That is, the propeller fan 1 may become lightweight by forming the recesses 460 and 560.

The side wall portion 110 and the support rib 140 of the hub body 100 and the front side walls 210 and 310 and the rear side walls 230 and 330 of the hub blades 200 and 300 may have the same thickness. Since the hub body 100 and the hub blades 200 and 300 may be integrally formed by injection molding, designing the side wall portion 110 and the support rib 140 constituting the hub body 100 and the front side walls 210 and 310 and the rear side walls 230 and 330 constituting the hub blades 200 and 300 to have the same thickness may facilitate injection molding.

Figure 6:
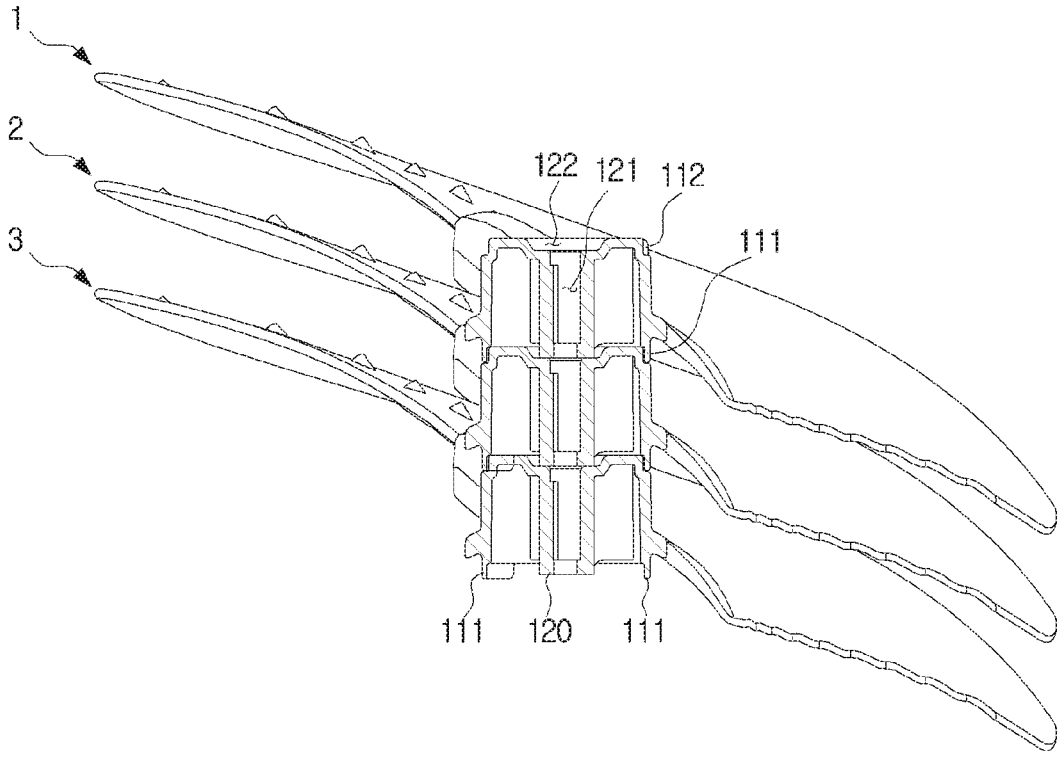
FIG. 6 illustrates a side cross-sectional view of the propeller fan of FIG. 1, showing a plurality of propeller fans stacked in the axial direction, according to an embodiment of the present disclosure.

As illustrated in FIGS. 2, 3, and 6, the hub body 100 may have a circular groove 122, a positioning groove 112, a shaft coupling portion 120, and a positioning projection 111.

The circular groove 122 and the positioning groove 112 may be formed on upper portions of the hub body 100 and the shaft coupling portion 120 and the positioning projection 111 may be formed on lower portions of the hub body 100.

The circular groove 122 may be provided such that the cylindrical shaft coupling portion 120 is inserted there into. The circular groove 122 may be located at the center of an upper surface of the hub body 100 to correspond to a position of the shaft coupling portion 120 and recessed downward from the upper surface of the hub body 100. At least one portion of the shaft coupling portion 120 may be inserted into the circular groove 122.

The positioning groove 112 may be formed at an edge of on the upper surface of the hub body 100. Two positioning grooves 112 may be provided at both sides of the circular groove 122. The two positioning grooves 112 may be provided symmetrically with each other. The positioning groove 112 may be formed by recessing an edge portion of the upper surface of the hub body 100 downward.

The positioning projection 111 may be provided at the side wall portion 110 of the hub body 100. Specifically, the positioning projection may be formed by protruding at least one portion of the side wall portion 110 downward. Two positioning projections 111 may be provided to correspond to the positioning grooves 112 at positions corresponding to the positioning grooves 112. That is, the two positioning projections 111 may be symmetrically located at both sides of the shaft coupling portion 120.

As the positioning projections 111 are fitted into the positioning grooves 112, the propeller fans vertically coupled with each other do not rotate relative to each other. Since relative rotations of propeller fans 1, 2, and 3 vertically provided cannot be prevented by merely joining the circular groove 122 and the shaft coupling portion 120, the positioning projections 111 and the positioning grooves 112 are used to prevent the relative rotations thereof. Thus, the plurality of propeller fans 1, 2, and 3 may be stably stacked in the axial direction with no contact between the blades 400 and 500 or between the hub blades 200 and 300. The propeller fans may be easily stored and transported by stacking the propeller fans in the axial direction.

Figure 7:
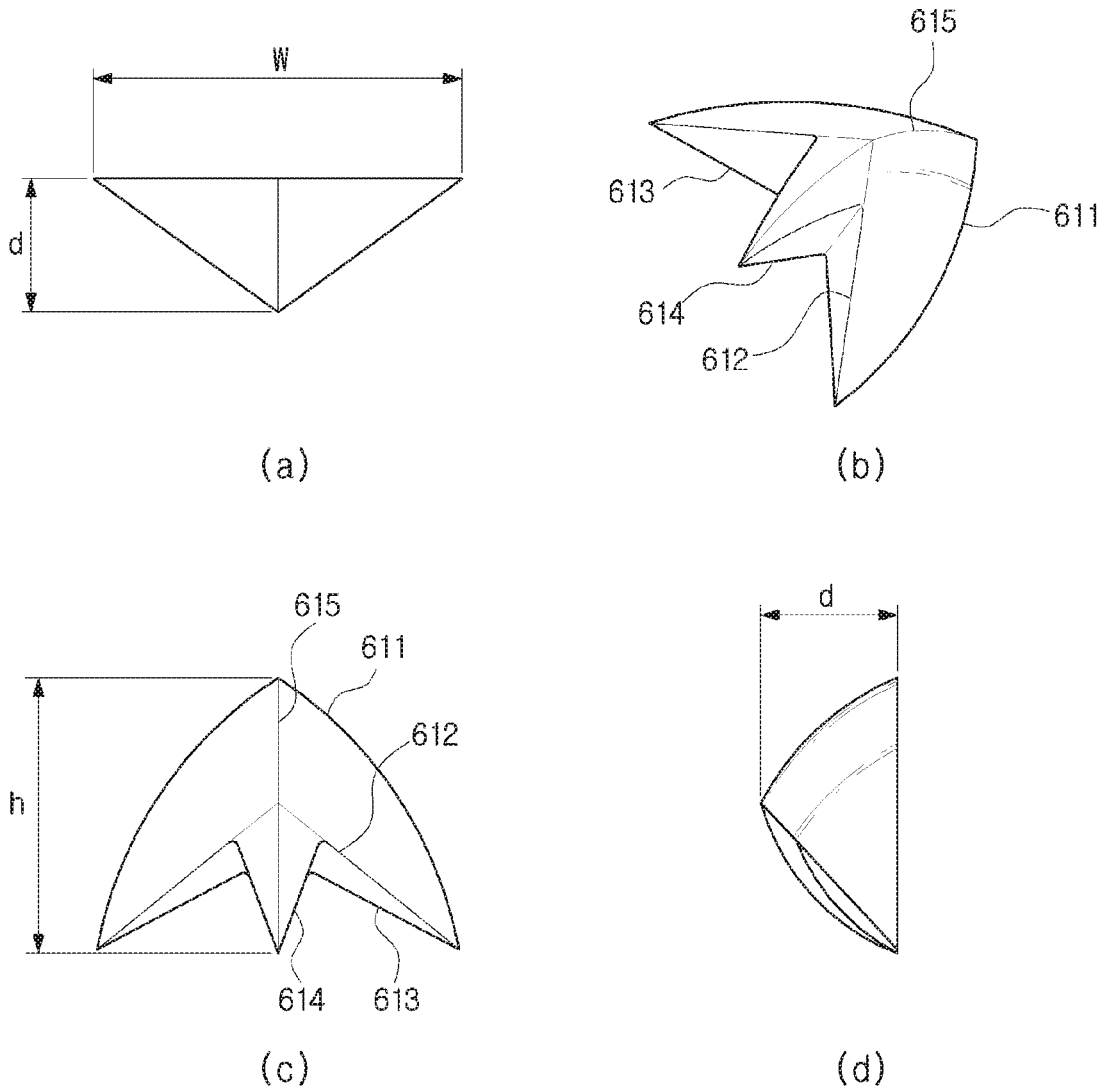
FIG. 7 illustrates a view showing vortex generators at various angles in the propeller fan of FIG. 1, according to an embodiment of the present disclosure.
Figure 8:
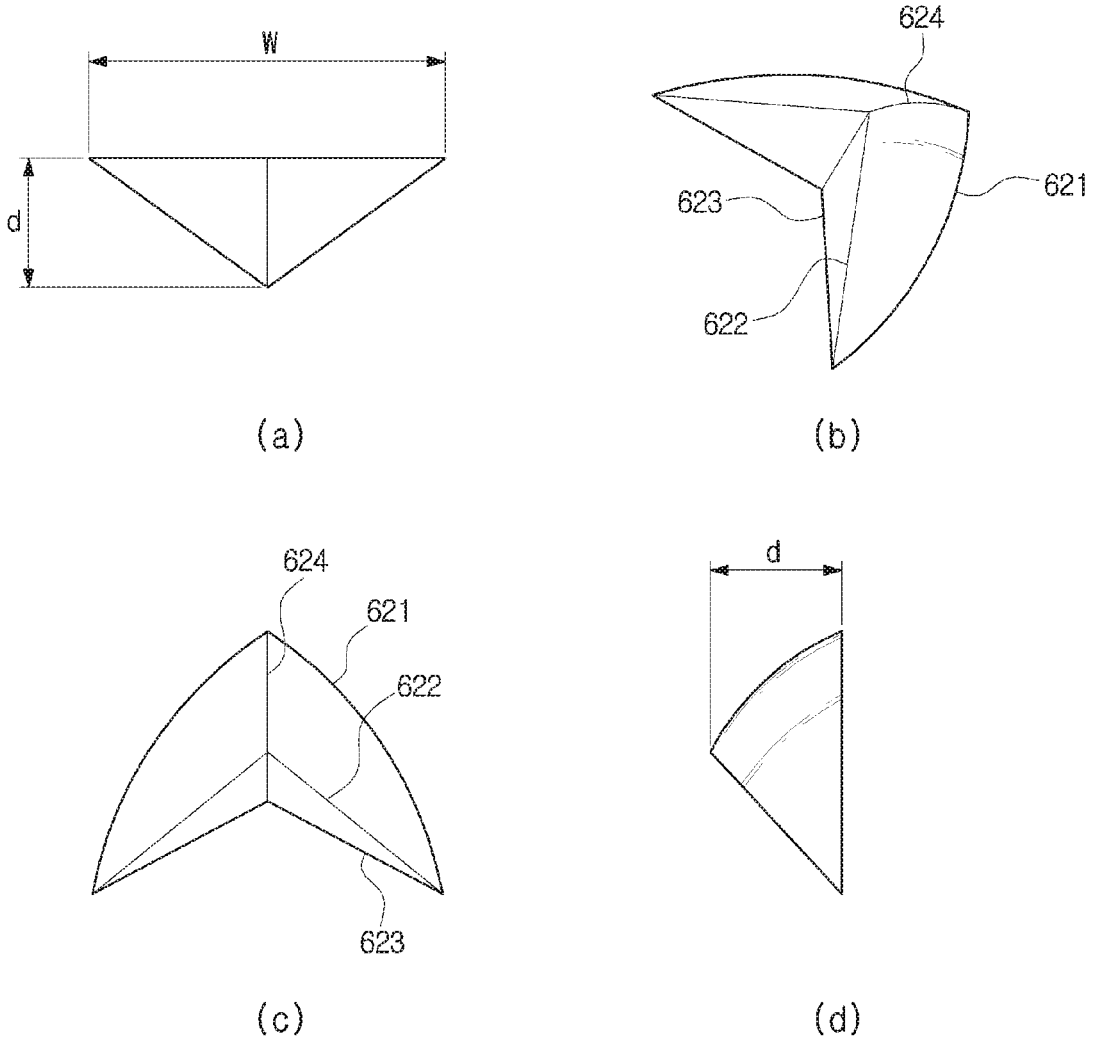
FIG. 8 illustrates a view showing vortex generators at various angles in a propeller fan, according to an embodiment of the present disclosure.
Figure 9:
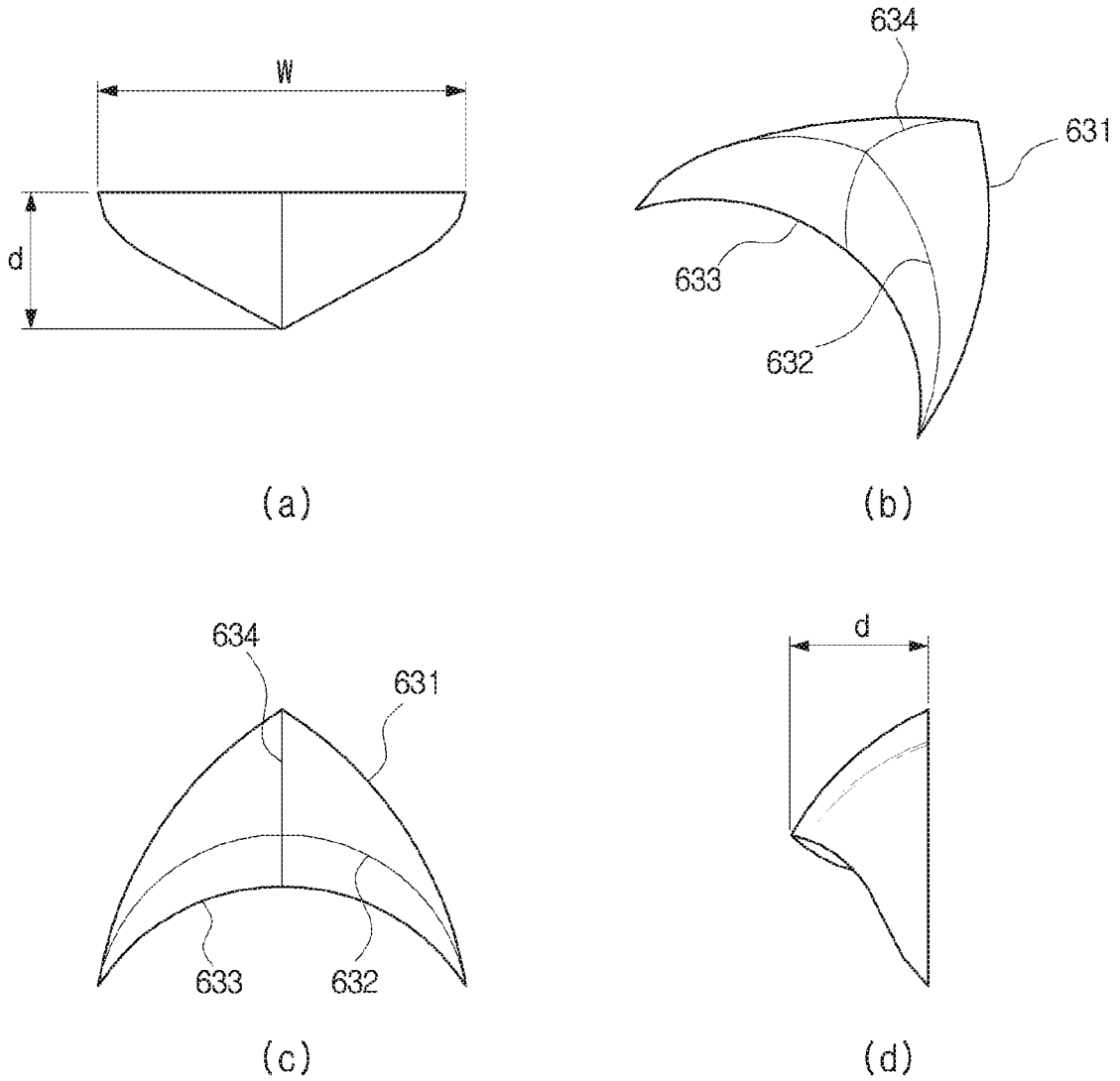
FIG. 9 illustrates a view showing vortex generators at various angles in a propeller fan, according to an embodiment of the present disclosure.

FIGS. 7 to 9 are diagrams illustrating vortex generators according to various embodiments used in the propeller fan of FIG. 1 and viewed at various angles.

As illustrated in FIG. 4, the blades 400 and 500 may include a plurality of vortex generators 600 to reduce flow resistance of the blades 400 and 500. The vortex generators 600 may be formed on the positive pressure surfaces 410 and 510 of the blades 400 and 500.

The vortex generators 600 may be disposed to be adjacent the leading edges 430 and 530 of the blades 400 and 500. The vortex generators 600 may be arranged at different distances along the leading edges 430 and 530 from the hub blades 200 and 300 to the tip edges 440 and 540. In particularly, the vortex generators 600 may be arranged such that the distance there between gradually increases from the hub blades 200 and 300 to the tip edges 440 and 540. That is, the distance between the vortex generators 600 may decrease as the vortex generators 600 are closer to the hub blades 200 and 300 and increase as the vortex generators 600 are closer to the tip edges 440 and 540.

The vortex generator 600 may delay flow separation points formed at the leading edges 430 and 530 while the propeller fan 1 rotates. Even when the blades 400 and 500 are designed at a high angle, the vortex generators 600 may reduce noise and flow resistance. As the angle of blades 400 and 500 increases, air volume increases but flow separation may increase noise and flow resistance. However, the vortex generators 600 delays the flow separation points so that the blades 400 and 500 receive less resistance of the airflow. In addition, the vortex generators 600 may reduce noise caused in the propeller fan 1 since the blades 400 and 500 receive less resistance of the airflow. Thus, the propeller fan 1 according to an embodiment may include the blades 400 and 500 formed at a higher angle with respect to the hub body 100 in comparison with conventional propeller fans.

As illustrated in FIG. 7, the vortex generator 600 according to an embodiment may include a front portion 611, a central portion 612, a rear portion 613, and a tail portion 614 along the rotational direction of the propeller fan 1.

The vortex generator 600 may have a thickness increasing from the front portion 611 to the central portion 612 and decreasing from the central portion 612 to the rear portion 613. Thus, the vortex generator 600 may have a maximum thickness at the central portion 612.

According to the present embodiment, the central portion 612 and the rear portion 613 may have an approximate V-shape when viewed from the positive pressure surfaces 410 and 510 of the blades 400 and 500. In this regard, the front portion 611 may form a curved edge. In addition, the tail portion 614 may extend from the central portion 612 backward and protrude to a rear end of the rear portion 613. Meanwhile, the vortex generator 600 may be symmetrical with respect to a centerline 615.

A ratio of a length h to width w of the vortex generator 600 may be less than 1. That is, a h/w ratio may be less than 1. In other words, the width w of the vortex generator 600 may be greater than the length h thereof.

A height d of the vortex generator 600 may be less than the width w thereof. Specifically, a ratio of width w to height h of the vortex generator 600 may be greater than 1 and less than 10.

As illustrated in FIG. 8, a vortex generator 600 according to another embodiment may include a front portion 621, a central portion 622, and a rear portion 623 along the rotational direction of the propeller fan 1.

The vortex generator 600 may have a thickness increasing from the front portion 621 to the central portion 622 and decreasing from the central portion 622 to the rear portion 623. Thus, the vortex generator 600 may have a maximum thickness at the central portion 622.

According to the present embodiment, the central portion 622 and the rear portion 623 may have an approximate V-shape when viewed from the positive pressure surfaces 410 and 510 of the blades 400 and 500. In this regard, the front portion 621 may form a curved edge. The vortex generator 600 may be symmetrical with respect to the centerline 615 and does not include a tail portion which is different from that of FIG. 7.

Meanwhile, in the same manner as in the embodiment illustrated in FIG. 7, a ratio of a length h to width w of the vortex generator 600 may be less than 1. That is, a h/w ratio may be less than 1. In other words, the width w of the vortex generator 600 may be greater than the length h thereof. In addition, a height d of the vortex generator 600 may be less than the width w thereof. Specifically, a ratio of width w to height h of the vortex generator 600 may be greater than 1 and less than 10

As illustrated in FIG. 9, a vortex generator 600 according to another embodiment may include a front portion 631, a central portion 632, and a rear portion 633 along the rotational direction of the propeller fan 1.

The vortex generator 600 may have a thickness increasing from the front portion 631 to the central portion 632 and decreasing from the central portion 632 to the rear portion 633. Thus, the vortex generator 600 may have a maximum thickness at the central portion 632.

According to the present embodiment, the central portion 632 and the rear portion 633 may have an approximate semicircular shape when viewed from the positive pressure surfaces 410 and 510 of the blades 400 and 500. In this regard, the front portion 631 may form a curve having a less curvature than the central portion 632 and the rear portion 633. The vortex generator 600 may be symmetrical with respect to a centerline 634.

Meanwhile, in the same manner as in the embodiment illustrated in FIGS. 7 and 8, a ratio of a length h to width w of the vortex generator 600 may be less than 1. That is, a h/w ratio may be less than 1. In other words, the width w of the vortex generator 600 may be greater than the length h thereof. In addition, a height d of the vortex generator 600 may be less than the width w thereof. Specifically, a ratio of width w to height h of the vortex generator 600 may be greater than 1 and less than 10

Figure 10:
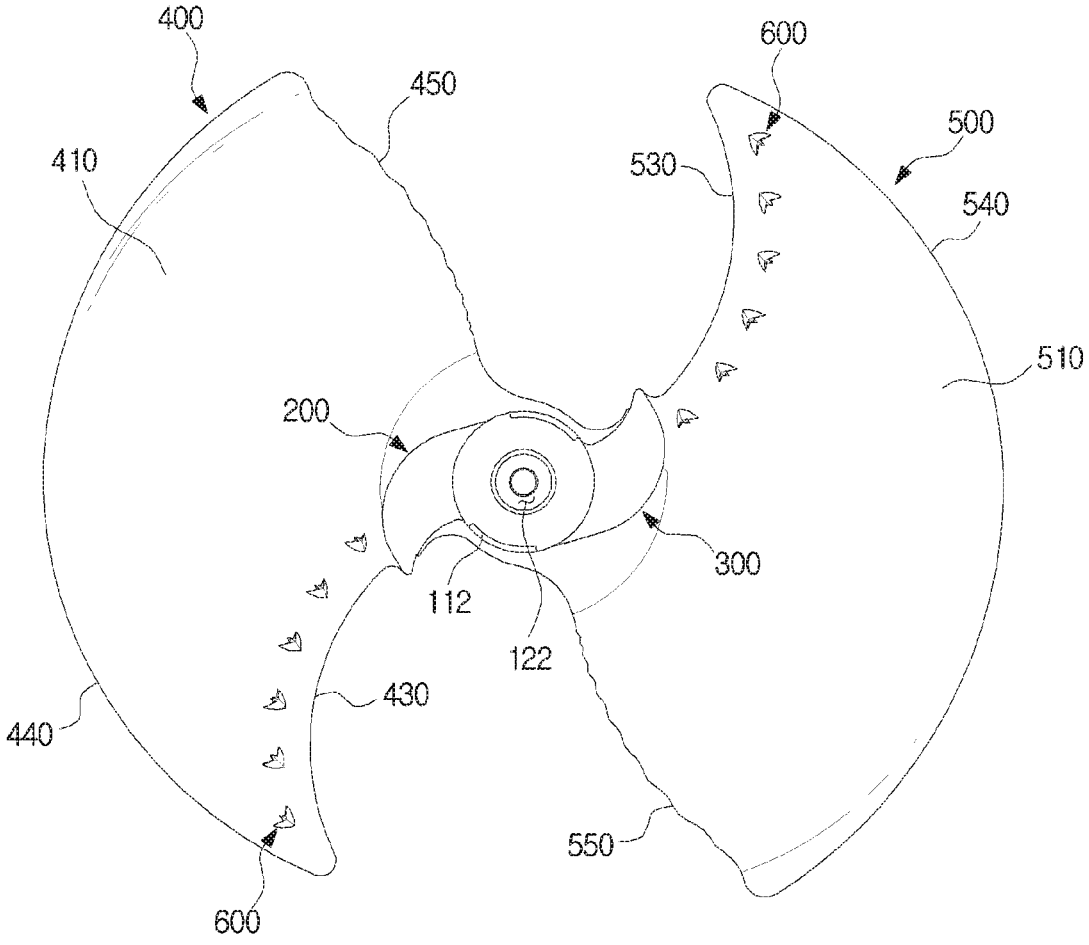
FIG. 10 illustrates a front view of a propeller fan, according to an embodiment of the present disclosure.

FIG. 10 is a front view of a propeller fan according to another embodiment.

As illustrated in FIG. 10, the vortex generators 600 may be arranged at the same distance from the hub blades 200 and 300 to the tip edges 440 and 540. According to the present embodiment, six vortex generators 600 may be provided on each blade. However, the present embodiment is not limited thereto, and the number of the vortex generators 600 may be greater or less than six. In addition, although FIG. 10 illustrates the vortex generator of FIG. 7, the present embodiment is not limited thereto and the vortex generators illustrated in FIGS. 8 and 9 may also be arranged at the same distance.

Figure 11:
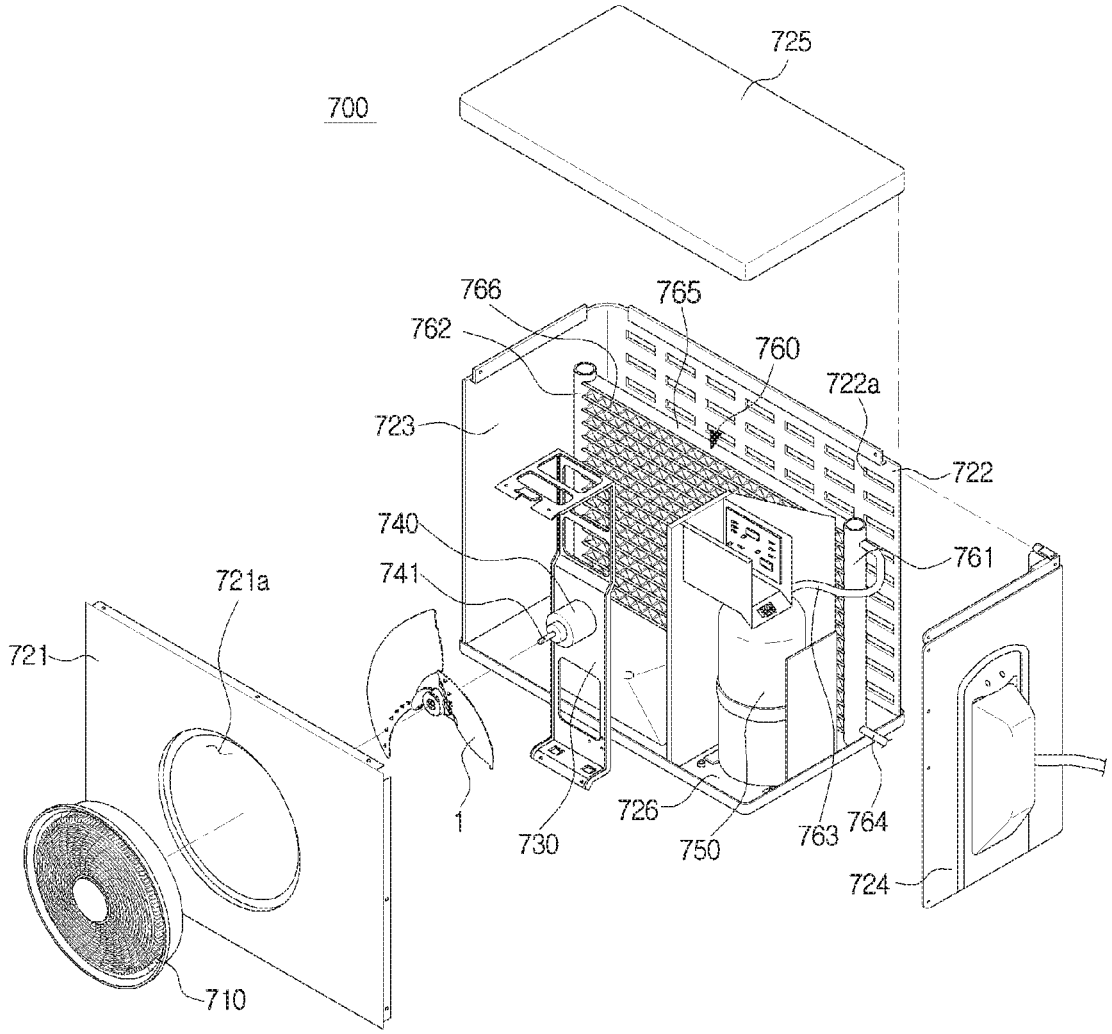
FIG. 11 illustrates a view illustrating an outdoor unit of an air conditioner provided with the propeller fan of FIG. 1, according to an embodiment of the present disclosure.

FIG. 11 is a view illustrating an outdoor unit of an air conditioner provided with the propeller fan of FIG. 1.

Referring to FIG. 11, an outdoor unit 700 may include a box-shaped main body. The main body may be formed by coupling a front plate 721, a rear plate 722, both side plates 723 and 724, a top plate 725, and a bottom plate 726.

The rear plate 722 and one side plate 723 may have a structure forward by bending one panel and the rear plate 722 may have suction ports 722*a* for sucking external air.

The front plate 721 may have a discharge port 721*a* to discharge air to the outside of the main body and a fan guard 710 to prevent foreign substances from entering the inside of the main body may be coupled to the discharge port 721*a*.

A compressor 750, a heat exchanger 760, and a blower may be disposed inside the main body. The blower may include the propeller fan 1 and the driving motor 740 to drive the propeller fan 1. The blower may be fixed to a support member 730 and the support member 730 may be fixed to the main body by coupling an upper end and a lower end thereof to the top plate 725 and the bottom plate 726 respectively.

The heat exchanger 760 may include a first header 761 and a second header 762 in which a space is formed, a plurality of tubes 765 connecting the first header 761 with the second header 762, and heat exchanging fins 766 in contact with the plurality of tubes 765.

A refrigerant at high temperature and high pressure compressed in the compressor 750 flows into the heat exchanger 760 via a first connection pipe 763 and the refrigerant condensed while passing through the heat exchanger 760 may be guided to an expansion valve (not shown) via a second connection pipe 764.

According to this configuration, air forced to flow by the blower is sucked via the suction ports 722*a*, absorbs heat while passing through the heat exchanger 760, and is discharged via the discharge port 721*a* to the outside of the main body.

As is apparent from the above description, according to the present disclosure, provided are a propeller fan having a lightweight and manufactured with low costs by increasing rigidity of blades and reducing the size of the hub and an air conditioner including the propeller fan.

According to the present disclosure, provided are a propeller fan including a small and lightweight hub with high rigidity by improving the structure of the hub and an air conditioner including the propeller fan.

According to the present disclosure, provided are a propeller fan in which stress is distributed to prevent concentration of the stress between blades and a hub and an air conditioner including the propeller fan.

According to the present disclosure, provided are a stackable propeller fan easily stored and transported and an air conditioner including the propeller fan.

According to the present disclosure, provided are a propeller fan providing a high air volume by increasing an angle of blades and low noise and an air conditioner including the propeller fan.

According to the present disclosure, provided are a propeller fan having improved air-flowing performance with a reduced volume and an air conditioner including the propeller fan.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A propeller fan comprising:

a hub body including a shaft coupling portion;

a plurality of hub blades extending spirally from the hub body; and a plurality of blades extending outward from the hub body and the plurality of hub blades and when rotated the plurality of blades generate an airflow in an axial direction, wherein each of the plurality of hub blades is connected between two adjacent blades of the plurality of blades.

2. The propeller fan according to claim 1, wherein:

each of the plurality of blades comprises a leading edge disposed at a front portion in a rotational direction, a trailing edge disposed at a rear portion in the rotational direction, and a tip edge connecting the leading edge with the trailing edge, and at least one portion of each of the plurality of hub blades protrudes in a forward direction of the leading edge.

3. The propeller fan according to claim 2, wherein:

each of the plurality of hub blades comprises a front side wall disposed at a front portion in the rotational direction, a rear side wall disposed at a rear portion of the rotational direction, and a connection portion configured to connect the front side wall with the rear side wall, and the connection portion protrudes in the forward direction of the leading edge to prevent stress from being concentrated on one portion of a blade of the plurality of blades.

4. The propeller fan according to claim 3, wherein:

the plurality of blades comprises a first blade and a second blade, the plurality of hub blades comprises a first hub blade and a second hub blade, and a leading edge of the first blade is connected to a rear side wall of the first hub blade and a trailing edge of the first blade is connected to a front side wall of the second hub blade.

5. The propeller fan according to claim 3, wherein:

the hub body comprises a side wall portion that the plurality of blades extend from and at least one support rib connecting the shaft coupling portion with the side wall portion, and the side wall portion, the support rib, the front side wall, and the rear side wall are of similar thickness in the axial direction.

6. The propeller fan according to claim 1, wherein an axial thickness of a hub blade of the plurality of hub blades is greater than an axial thickness of a blade of the plurality of blades.

7. The propeller fan according to claim 1, wherein:

each of the plurality of blades comprise a positive pressure surface, a negative pressure surface, and a plurality of recesses formed on the negative pressure surface to reduce a thickness of each blade of the plurality of blades, and the plurality of recesses are disposed behind each of the plurality of the hub blades in a rotational direction.

8. The propeller fan according to claim 1, wherein:

the hub body comprises a positioning projection and a positioning groove to allow one or more additional propeller fans to be stacked in the axial direction, and the positioning projection is formed on an upper surface or a lower surface of the hub body, the positioning groove is formed on a lower surface or an upper surface of the hub body, and the positioning projection and the positioning groove includes shapes corresponding to each other to be axially coupled.

9. The propeller fan according to claim 1, wherein each of the plurality of blades comprises a plurality of vortex generators formed on a positive pressure surface of the plurality of blades to reduce flow resistance of the plurality of blades.

10. The propeller fan according to claim 9, wherein:

each of the plurality of blades comprises a leading edge disposed at a front portion in a rotational direction, a trailing edge disposed at a rear portion in the rotational direction, and a tip edge connecting the leading edge with the trailing edge, and the plurality of vortex generators are arranged at distances gradually increasing from the hub body to the tip edge.

11. A propeller fan comprising:

a hub body including a shaft coupling portion;

a blade extending outward from the hub body and when rotated the blade generates an airflow in an axial direction;

a plurality of vortex generators formed on a positive pressure surface of the blade and arranged at distances gradually increasing from the hub body to an end portion of the blade; and a hub blade connected between the blade and an adjacent blade.

12. The propeller fan according to claim 11, wherein:

each of the plurality of vortex generators comprises a front portion, a central portion, and a rear portion along a rotational direction of the blade, and each of the plurality of vortex generators increase in a thickness from the front portion to the central portion and decrease in thickness from the central portion to the rear portion, wherein the central portion is a maximum thickness.

13. The propeller fan according to claim 12, wherein the central portion and the rear portion are V-shapes when viewed in the axial direction.

14. The propeller fan according to claim 13, wherein each of the plurality of vortex generators further comprises a tail portion protruding backward from the central portion to a rear end of the rear portion.

15. An air conditioner comprising:

a main body;

a heat exchanger disposed inside of the main body;

a propeller fan configured to force air inside the main body to flow; and a driving motor configured to drive the propeller fan, wherein the propeller fan comprises:

a hub body including a shaft coupling portion that a rotary shaft of the driving motor is coupled, a blade extending outward from the hub body and generating an airflow in an axial direction, a plurality of vortex generators formed on a positive pressure surface of the blade and reducing flow resistance of the blade, and a hub blade extending spirally from the hub body and connected between the blade and an adjacent blade, reinforcing strength of the blade.

16. The air conditioner according to claim 15, wherein:

the blade comprises a leading edge disposed at a front portion in a rotational direction, a trailing edge disposed at a rear portion in the rotational direction, and a tip edge connecting the leading edge with the trailing edge, and at least one portion of the hub blade protrudes in a forward direction of the leading edge.

17. The air conditioner according to claim 16, wherein:

the hub blade comprises a front side wall disposed at a front portion in the rotational direction, a rear side wall disposed at a rear portion in the rotational direction, and a connection portion configured to connect the front side wall with the rear side wall, and the connection portion protrudes in a forward direction of the leading edge to prevent stress from being concentrated on one portion of the blade.

18. The air conditioner according to claim 17, wherein:

the blade comprises a first blade and a second blade, the hub blade comprises a first hub blade and a second hub blade, and a leading edge of the first blade is connected to a rear side wall of the first hub blade and a trailing edge of the first blade is connected to a front side wall of the second hub blade.

19. The air conditioner according to claim 16, wherein the plurality of vortex generators is arranged at distances gradually increasing from the hub blade to the tip edge.

20. The air conditioner according to claim 15, wherein each of the plurality of vortex generators comprise:

a front portion, a central portion, and a rear portion along a rotational direction of the blade, and a tail portion protruding from the central portion to a rear end of the rear portion.

* * * * *